US007565706B2

(12) United States Patent
Janssen

(10) Patent No.: US 7,565,706 B2
(45) Date of Patent: Jul. 28, 2009

(54) PRESSURE ASSISTED FLUSH ASSEMBLY AND INSTALLATION METHODS

(76) Inventor: Terrance E. Janssen, 252 Hermosita Dr., St. Pete Beach, FL (US) 33706

( * ) Notice: Subject to any disclaimer, the term of this patent is extended or adjusted under 35 U.S.C. 154(b) by 433 days.

(21) Appl. No.: 11/252,351

(22) Filed: Oct. 17, 2005

(65) Prior Publication Data

US 2006/0085901 A1 Apr. 27, 2006

Related U.S. Application Data

(60) Provisional application No. 60/619,415, filed on Oct. 15, 2004.

(51) Int. Cl.
*E03D 1/00* (2006.01)

(52) U.S. Cl. ..... 4/353; 4/661; 4/419

(58) Field of Classification Search ..... 4/353, 4/417–419, 661

See application file for complete search history.

(56) References Cited

U.S. PATENT DOCUMENTS 1,032,317 A * 7/1912 Zwermann ..... 4/353
1,067,894 A * 7/1913 Zwermann ..... 4/419
1,785,872 A * 12/1930 McCann ..... 4/419
1,943,041 A * 1/1934 Reynolds ..... 4/419
2,651,052 A * 9/1953 Madson ..... 4/251.2
4,148,105 A * 4/1979 Napolitano ..... 4/353
4,368,551 A * 1/1983 Cummings ..... 4/661
5,073,998 A * 12/1991 Wood et al. ..... 4/661

OTHER PUBLICATIONS

Product Data Sheet. Classic Vacuity. Briggs. Retrieved on Apr. 11, 2006. Retrieved from the Internet: http://.briggsplumbing.com/products/pdp.asp?cid=1&pid=86. 1 page.
Product Data Sheet. Caroma Toilets. Caroma USA, Inc. Retrieved on Apr. 11, 2006. Retrieved from the Internet: http://www.caromatoilets.com. 3 pages.
Product Data Sheet. "Aqua-Saver Pressure Assist 1.6 Toilets," Eljer. (1 page).
Product Data Sheet. "Pressure Lite™ Toilet Tank," Kohler. Retrieved on Feb. 10, 2006. Retrieved from the Internet: http://www.ca.kohler.com/onlinecatalog/detail.jsp?item=281702&prod_num=4413 &modu... . 1 page.

(Continued)

*Primary Examiner*—Tuan N Nguyen
(74) *Attorney, Agent, or Firm*—Mueting Raasch & Gebhardt, P.A.

(57) ABSTRACT

A pressure assisted flush assembly for use with a toilet includes a compressed air assisted flush water tank that includes a plunger device. One or more plumbing lines are used to connect an incoming water line to the flush water tank and the flush water tank to a toilet bowl. At least one panel is used to enclose the flush water tank (e.g., mounted against a wall). The enclosure comprises an access door configured to allow access to the flush water tank and the access door is secured with a lock mechanism to prevent unauthorized access to the flush water tank. Further, for example, an accessible activator mechanism is configured to activate the plunger of the flush water tank. The assembly may be, for example, configured to retrofit a previously installed flush valve toilet.

20 Claims, 9 Drawing Sheets

OTHER PUBLICATIONS

Product Data Sheet. "4098—Cadet Round Frount Pressure Assist Toilet Tank on Standard," Lighting Universe. Retrieved on Feb. 10, 2006. Retrieved from the Internet: http://www.lightinguniverse.com/products/view.aspx?a=a&family=120058. 2 pages.
Product Data Sheet. "PF/2® Energizer Design," Chicago Faucets. Retrieved on Mar. 14, 2006. Retrieved from the Internet: http://www.chicagofaucets.com/pf2/pf2.php 2 pages.
Flushmate® Models. Retrieved on Oct. 14, 2005. Retrieved from the Internet: http://www.flushmate.com/Model2005/default.asp 2 pages.
"Pressure Assisted Water Closet Equipped with Flushmate® IV." Retrieved on Oct. 14, 2005. Retrieved from the Internet: http://www.flushmate.com/Model2005/brand.asp?market=1&marketType=2&brand=63. 2 pages.
Flushmate® Models—Description by Series. Sloan Flushmate (A Division of Sloan Valve Company). Data Sheet. 1 page.
Flushmate® IV for MPF™ Toilets. Product Data Sheet and Descriptions Brochure. 4 pages.
Flushmate® Pressure Assist Operating System. Brochure. 4 pages.
Flushmate® Flushometer—Tank System. Owner's Service Manual, 504 Series. 6 pages.

* cited by examiner

Fig. 5
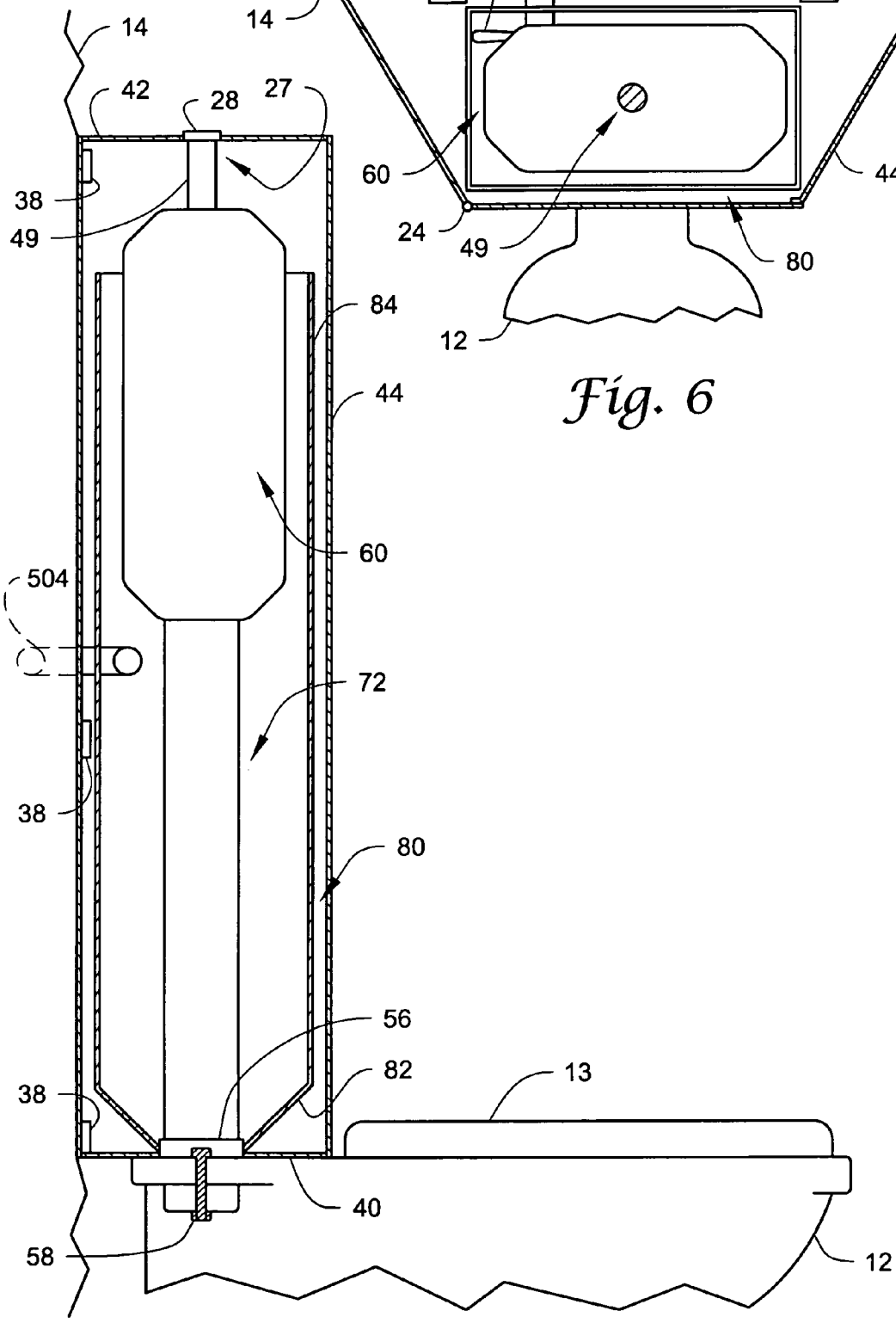
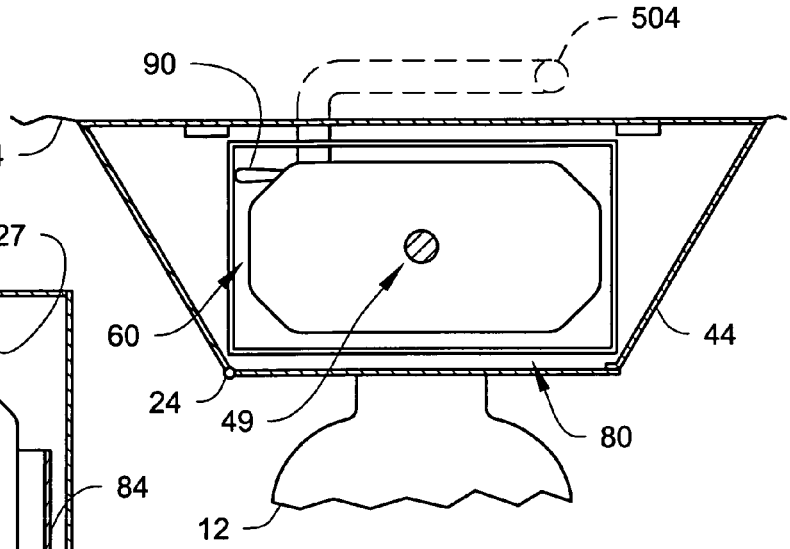
Fig. 6

PRESSURE ASSISTED FLUSH ASSEMBLY AND INSTALLATION METHODS

This application claims the benefit of U.S. Provisional Application Ser. No. 60/619,415, filed Oct. 15, 2004, which is incorporated by reference herein.

BACKGROUND OF THE INVENTION

The present invention relates to pressure-assisted flush assemblies and methods for installing the assemblies (e.g., retrofitting flush valve toilets).

Various toilets are available for installation at various facilities (e.g., residential and/or commercial facilities). For example, flush valve toilets (e.g., such as the flush valve toilet shown in FIG. 2), non-flush valve toilets generally referred to as water closets, toilets including wall mounted toilet bowls, toilets employing floor-mounted toilet bowls, toilets including toilet tanks, etc., are available for installation. Various techniques have been used to make such toilet installations ecologically friendly, have better performance, as well as being commercially aesthetic.

For example, a compressed air-assisted flush water tank, such as the commercially-available flush water tank available from Sloan Valve Company (Franklin Park, Ill.), and referred to or sold under the trade designation FLUSHMATE® (e.g., 200, 500, 501, 501-A, 501-B, 503, and 504 series); the Aqua Saver pressure assisted toilet available from Eljer Plumbingware Inc.; the Cadet Round Frount Pressure Assist Toilet available from American Standard Companies; the K-1413 Pressure Lite Toilet Tank available from Kohler Co.; or the PF/2 Energizer System available from Chicago Faucets, have been used to save water; for example, when the compressed air-assisted flush water tank is installed in a ceramic tank of a toilet and connected to a water supply. In operation, for example, as water from the water supply line fills the compressed air-assisted flush water tank, the air becomes trapped and is compressed. Air pressure builds until it is approximately equal to the water supply line pressure, at which time the water flow stops and the compressed air-assisted flush water tank is ready to be used (i.e., flushed). When a plunger device of the compressed air-assisted flush water tank is activated, a combination of air and water is released, creating a jet or turbo propulsion effect. In other words, the compressed air inside the tank increases the potential energy of the entire toilet system. When the toilet is flushed, energy within the tank pushes the water into a pressure assisted toilet bowl.

Such a system is ecologically friendly because it uses only a small amount of water (e.g., 0.8 gallons) per flush, and, typically, all waste disappears with one flush.

Further, for example, to avoid vandalism and to maintain commercial aesthetics, most commercial toilets do not have toilet tanks into which a pressure-assisted flush water tank, such as the FLUSHMATE® water tank, can be used. Rather, in many cases, flush valve toilets, such as those shown in FIG. 2, are used for commercial applications.

However, there is a significant trend towards eliminating flush valve toilets. For example, generally, the lowest flush rate in a flush valve toilet is 1.6 gallons per flush, with many flush valve toilets using 3.0 to 3.5 gallons per flush. Further, flush valves are very sensitive to small particles, typically found in domestic water lines from scaling and minute dirt particles. The result of any minute particle in the water line may cause a flush valve malfunction if it finds its way to the water supply entry in the flush valve. Typically, if this malfunction occurs, the valve will not shut off completely, allowing thousands of gallons of water to escape down the drain before it is detected or repaired. In many circumstances, the valve may not work at all and cause unsanitary conditions (e.g., water damage, mold, etc.) until the malfunction is detected and repaired.

Other flush valve failures occur on a regular basis, in addition to the malfunction problems associated with particles in the line. The flush valves have an interior kit that needs to be replaced fairly frequently based on usage of the fixture. The necessity to continually replace flush valve kits is an expensive problem. If a facility does not have their own maintenance personnel, a plumber has to be called to replace the flush valve kit. If the facility does have maintenance personnel, the cost and inconvenience are also high. Many times when the flush valve kit is replaced, it may undesirably get replaced with a higher flush volume kit. Generally, such flush valve kits are made in 1.6 to 3.5 gallons per flush configurations.

Yet further, vandalism is also a problem with flush valves in toilets in many public restrooms, such as schools, shopping malls, and at bars. Mischievous students or patrons can readily cause flush valves to stick open, resulting in extensive water waste and expensive flooding, especially if the mishap occurs on upper floors of a building.

As a result of such problems, many venues, such as schools and other facilities containing public restrooms, have been seeking ways to retrofit flush valve toilets. Although tank-type toilets (e.g., residential-type toilets that use a toilet tank that sits and is mounted to the back of the toilet bowl) could be used to retrofit such flush valve toilets, such retrofit is not without extensive changes to the plumbing and would require extensive building renovation. Further, use of such tank-type toilets also has problems associated therewith, particularly when used in a commercial setting. For example, vandalism is generally a problem with such tank-type toilets. Further, at least in commercial settings, there is a desire to maintain commercial aesthetics (e.g., aesthetics that typically do not include a tank-type toilet).

SUMMARY OF THE INVENTION

At least in one embodiment, the present invention accomplishes aesthetically pleasing results in retrofitting toilets. Such toilets are retrofitted using compressed air-assisted flush water tanks. Further, according to one embodiment of the present invention, such a retrofit is ecologically friendly as it uses, for example, only a small amount of water (e.g., one gallon or less of water per flush, such as a 0.8 gallon flush) and all waste disappears with one flush. At least in one embodiment, the present invention is aesthetically pleasing in that it hides all plumbing connections and old wall penetrations without expensive repair and restoration. In addition to the use of less water than other types of toilets, the present invention also deters vandalism.

In one embodiment, a pressure-assisted flush assembly for use with a toilet is provided. The pressure-assisted flush assembly includes a compressed air-assisted flush water tank. The flush water tank includes a plunger device configured to operate the flush water tank. One or more plumbing lines (e.g., pipes, tubes, fittings, etc.) connect an incoming water line to the flush water tank and the flush water tank to a toilet bowl. At least one panel is used in enclosing the flush water tank. The at least one panel includes an access door configured to allow access to the flush water tank. Further, the access door is secured with a lock mechanism to prevent unauthorized access to the flush water tank. An accessible activator mechanism (e.g., pushbutton, motion sensor, Etc.) is configured to activate the plunger device of the flush tank.

In one embodiment, the assembly is configured to retrofit a previously installed toilet. For example, the previously installed toilet may be a flush valve toilet, or a toilet with a toilet tank.

In another embodiment of the assembly, the at least one panel is configured for attachment to a wall to enclose the flush water tank and cover any plumbing lines (e.g., pipes, tubes, fittings, etc.) in the wall connected to the flush water tank. In another embodiment of the assembly, the assembly further comprises a water holding container enclosed by the at least one panel and positioned at least partially beneath the flush water tank. The water holding container defines an interior thereof in which a float switch is positioned. An automatic water supply shutoff valve is configured to be actuated by the float switch.

Yet further, in another embodiment of the assembly, the at least one panel enclosing the flush water tank includes a bottom panel configured to allow plumbing lines (e.g., nuts, screws, gaskets, valves, pipes, tubes, fittings, drip trays, etc.) to connect the flush water tank to the toilet bowl and secure the bottom panel to the toilet bowl. Further, one or more side panels are configured to allow plumbing lines (e.g., nuts, screws, gaskets, valves, pipes, tubes, fittings, drip trays, etc.) to connect a water supply to the flush water tank and to secure the one or more side panels to a wall. Yet further, a top panel is also included.

In one embodiment, the top panel includes the access door as a part thereof and configured to allow access to the flush water tank. The access door is removable from other portions of the top panel, and the top panel includes an accessible activator mechanism (e.g., pushbutton, motion sensor, etc.) coupled to the plunger device configured to operate the flush water tank. In other embodiments, the access door may be hinged to portions of the top panel or one or more side panels.

A method for use in installing a toilet is also provided according to the present invention. The method includes providing a compressed air-assisted flush water tank that includes a plunger device configured to operate the flush water tank. An incoming water line is connected to the flush water tank and the flush water tank is also connected to a toilet bowl. The flush water tank is enclosed using at least one panel. The at least one panel includes an access door configured to allow access to the flush water tank. The access door is secured with a lock mechanism to prevent unauthorized access to the flush water tank. Further, the method includes installing an accessible activator mechanism (e.g., pushbutton, motion sensor, etc.) for use in activation of the plunger device of the flush water tank.

In one embodiment of the method, the method further includes removing a flush valve on a previously installed toilet. Alternatively, the method may include removing at least a toilet tank on a previously installed toilet and/or toilet bowl.

In another embodiment of the method, the method includes enclosing the flush water tank using at least one panel by attaching the at least one panel to a wall to enclose the flush water tank and cover any plumbing lines (e.g., pipes, tubes, fittings, etc.) in the wall connected to the flush water tank.

In yet another embodiment of the method, a water holding container enclosed by the at least one panel is positioned at least partially beneath the flush water tank. The water holding container defines an interior thereof. A float switch is positioned in the interior of the water holding container at an initial location. A water supply to the flush water tank is automatically shut off based on a changed location of the float switch.

An enclosure for use in retrofitting a toilet with an assisted flush water tank (e.g., a compressed air-assisted tank, a vacuum assisted tank, a dual flush tank, etc.) is also provided according to the present invention. Generally, the flush water tank includes a plunger device configured to operate the flush water tank (e.g., manually or automatically). The enclosure includes a bottom panel configured to allow plumbing lines (e.g., pipes, tubes, fittings, etc.) to connect the flush water tank to a toilet bowl and configured to secure the bottom panel to the toilet. The enclosure further includes a top panel and one or more side panels extending from the bottom panel to the top panel configured to enclose the flush water tank. The one or more side panels or the bottom panel are configured to allow plumbing lines (e.g., pipes, tubes, fittings, etc.) to connect a water supply to the flush water tank and configured to secure the one or more side panels to a wall. Either the top panel or the one or more side panels includes an access door configured to allow access to the flush water tank. The access door is movable relative to other portions of the panel employed and is secured with a lock mechanism to prevent unauthorized access to the flush water tank.

In one embodiment, the top panel, bottom panel, and the one or more side panels are configured to cover a removed flush valve connection of a previously installed toilet and any plumbing lines (e.g., pipes, tubes, fittings, etc.) in the wall connected to the flush water tank.

Although various features are provided in the above summary, it will be understood that the present invention may include one or more of such features in combination, and/or include such features alone or in combination with one or more other features described herein.

The above summary of the present invention is not intended to describe each embodiment or every implementation of the present invention. Advantages, together with a more complete understanding of the invention, will become apparent and appreciated by referring to the following detailed description and claims taken in conjunction with the accompanying drawings.

BRIEF DESCRIPTION OF THE DRAWINGS

FIG. 5 is a cross-section side view of the toilet shown in FIGS. 1 and 3-4 taken along line 5-5 of FIG. 4.

FIG. 6 is a cross-section top view of the toilet shown in FIGS. 1 and 3-5 taken along line 6-6 of FIG. 3.

DETAILED DESCRIPTION OF THE EMBODIMENTS

The present invention shall be described with reference to FIGS. 1-12. Various illustrative embodiments of a toilet, and/or components thereof, according to the present invention are shown in FIGS. 1 and 3-12. FIG. 2 shows a prior art flush valve toilet that may be retrofitted according to the present invention.

One skilled in the art will recognize, from the description herein, that various illustrative embodiments described include some features or elements included in other illustrative embodiments and/or exclude other features or elements. However, a toilet, method, enclosure, assembly, a retrofit kit, or an apparatus and/or system comprising one or more elements or features described herein according to the present invention, may include any combination of features or elements selected from one or more of the various embodiments as described herein with reference to FIGS. 1-12. For example, one or more embodiments may include an access door that is provided on a side panel as opposed to a top panel of an enclosure of the toilet. However, it will be recognized that the access door may be hinged and/or otherwise associated with or connected to one or more other panels of the enclosure at one or more locations (e.g., removable from other portions of the panel). Further, for example, a toilet may be retrofitted by using one of various pressure assisted toilet bowls as a replacement for a previously installed toilet bowl. Still further, as opposed to a retrofit situation, the present invention and components thereof may be used for new construction as well. One skilled in the art will readily recognize that any number of various embodiments of a toilet may benefit from one or more of the features described herein.

Figure 1:
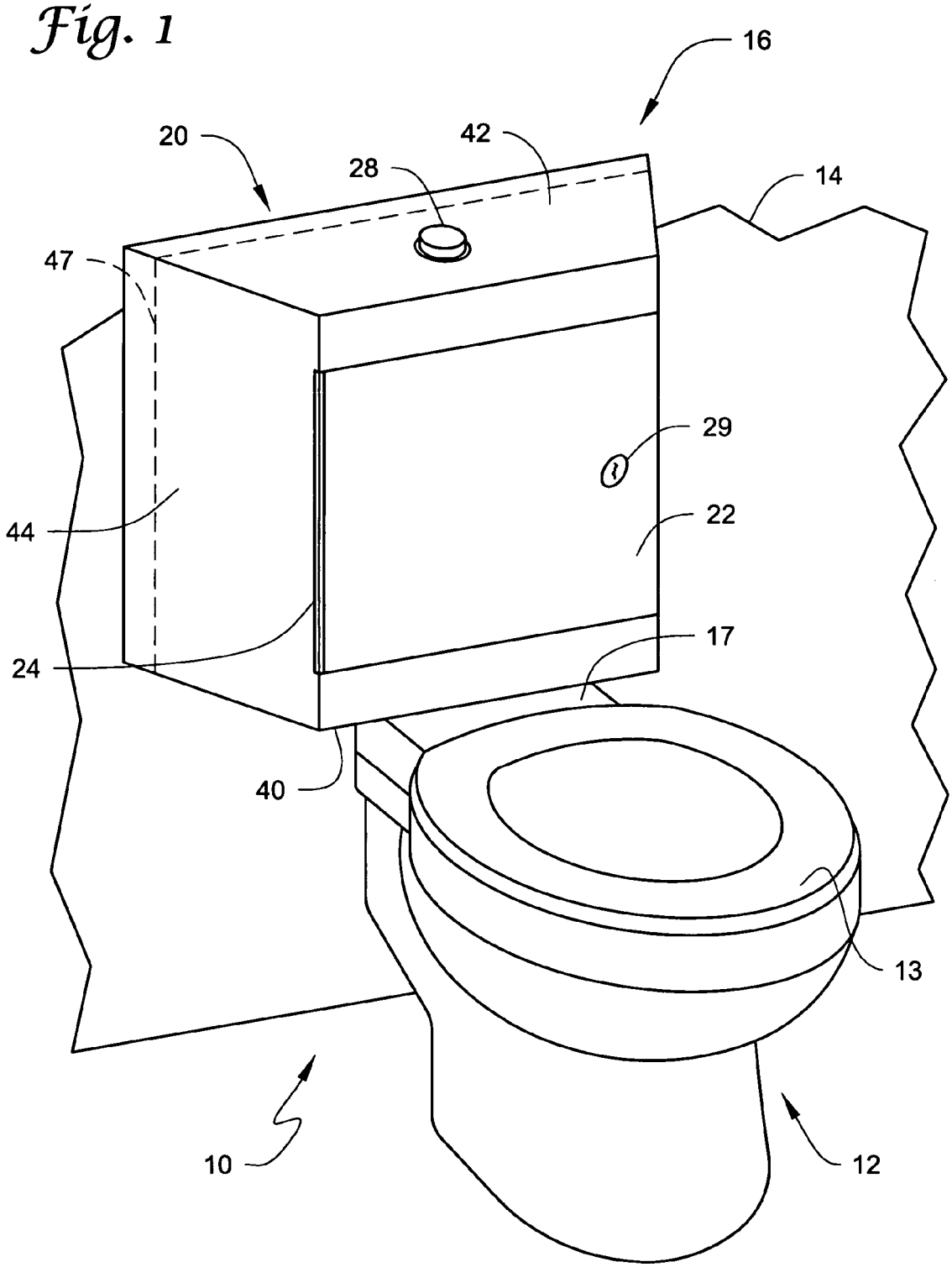
FIG. 1 is a perspective view of a toilet according to the present invention.
Figure 2:
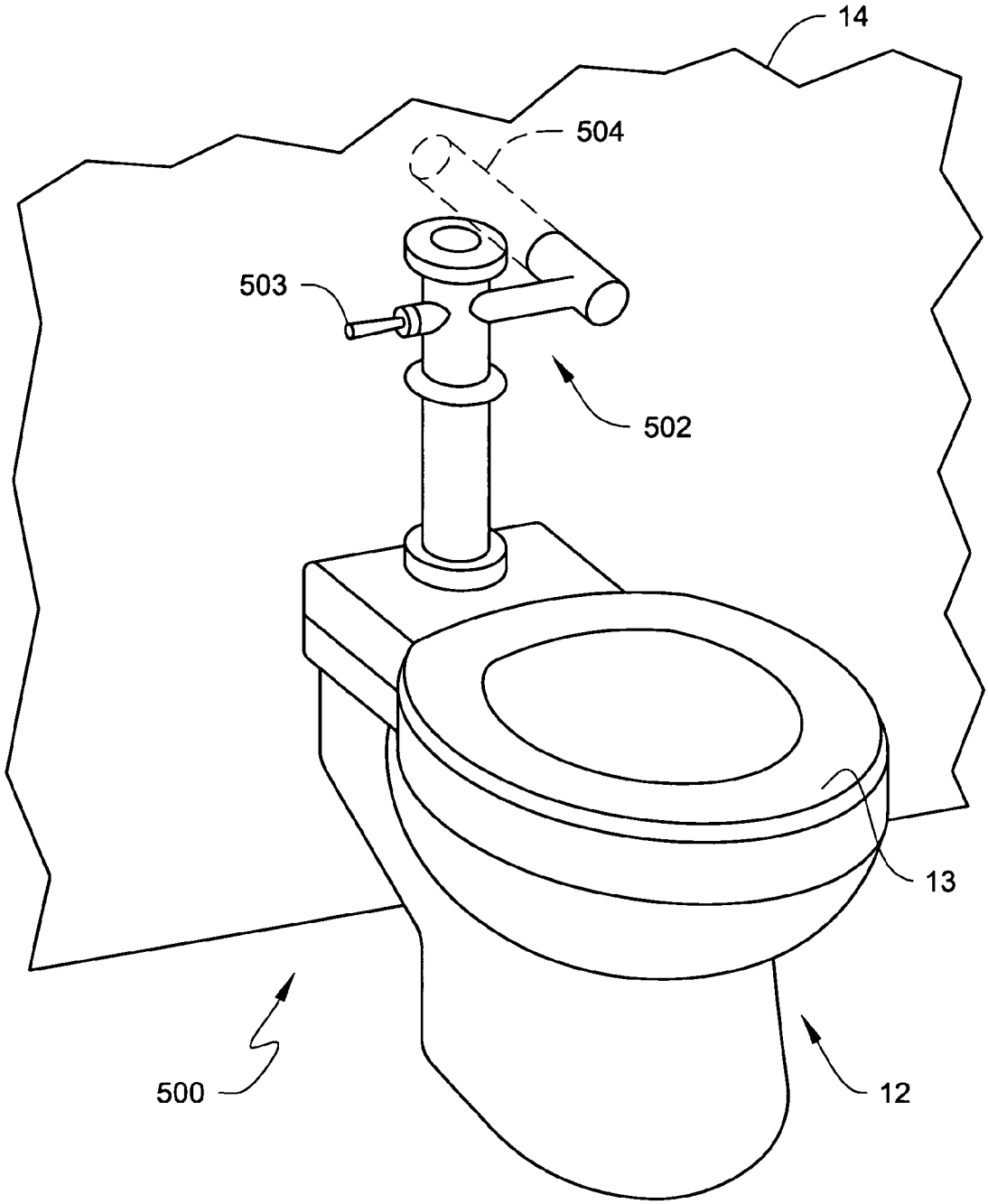
Fig. 2 (PRIOR ART)
FIG. 2 is a perspective view of a flush valve toilet known in the prior art which may be retrofitted according to the present invention.

FIG. 1 shows a perspective view of a toilet 10 according to the present invention including a toilet bowl 12 with accompanying attached seat 13 and a pressure-assisted flush assembly 16. The pressure-assisted flush assembly 16 is secured to a surface 17 at the rear of the toilet bowl 12 (e.g., rear of seat 13). At least in one embodiment, the pressure-assisted flush assembly 16 (and/or components thereof) is mounted and/or otherwise secured to the toilet bowl 12 using enclosure 20.

Figure 4:
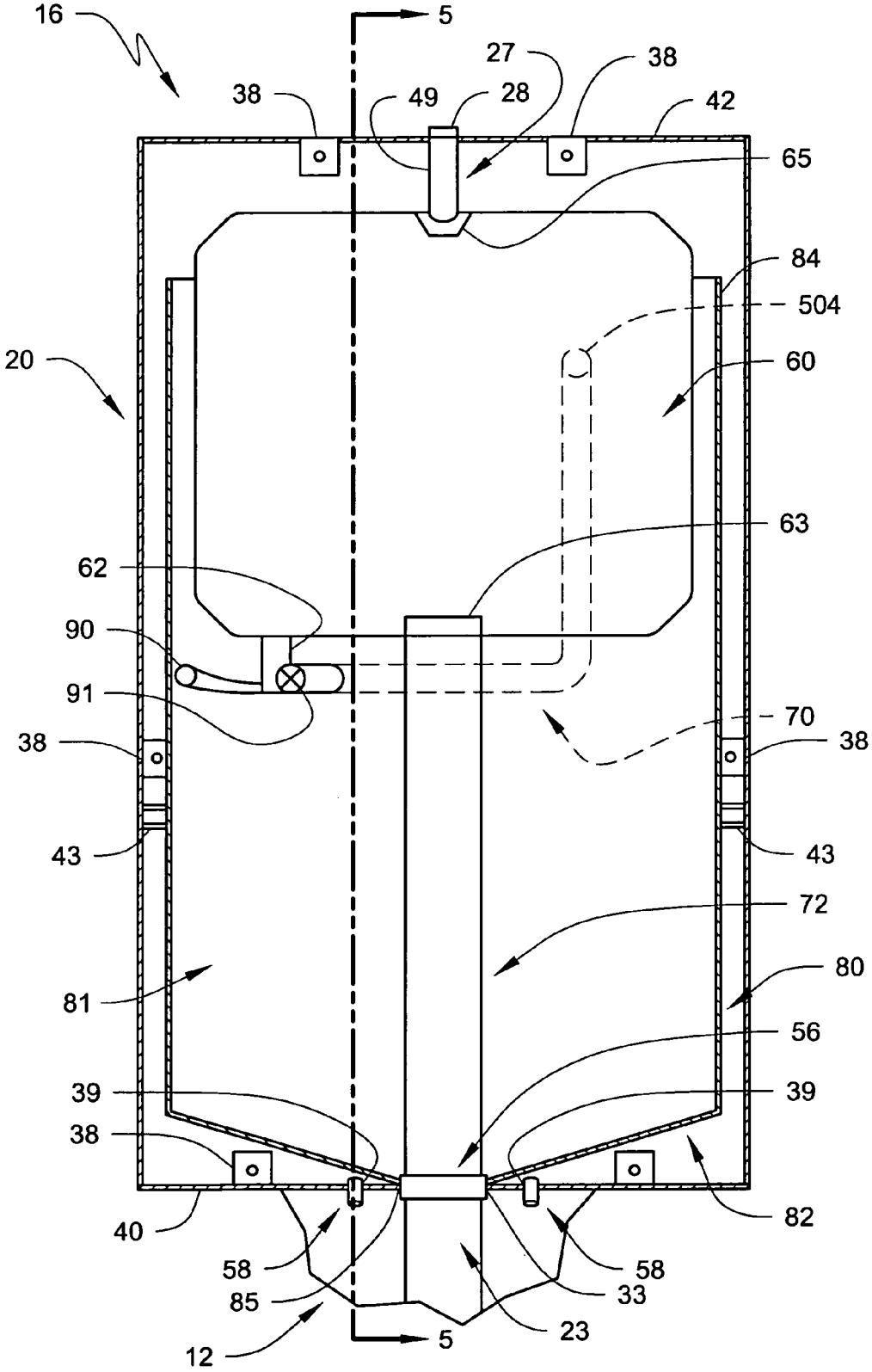
FIG. 4 is a front view of the toilet shown in FIGS. 1 and 3, with portions of the enclosure of a pressure-assisted flush assembly being removed to show other components of the pressure-assisted flush assembly enclosed therein according to the present invention.

Enclosure 20 (e.g., cabinet), at least in one embodiment, is secured to wall 14 and includes at least one panel for use in enclosing a flush water tank 60 (e.g., a compressed air-assisted flush water tank as generally shown in FIG. 4). The at least one panel that forms enclosure 20 comprises an access door 22 configured to allow access to the enclosed flush water tank 60. The access door is pivotable about hinge 24 and is secured with a lock mechanism to prevent unauthorized access to the flush water tank 60. Further, an accessible activator mechanism 28 is provided and configured (e.g., mounted to a portion of the panel enclosing the flush water tank) to activate the plunger device associated with the compressed air-assisted flush water tank (see, for example, FIG. 4).

Figure 3:
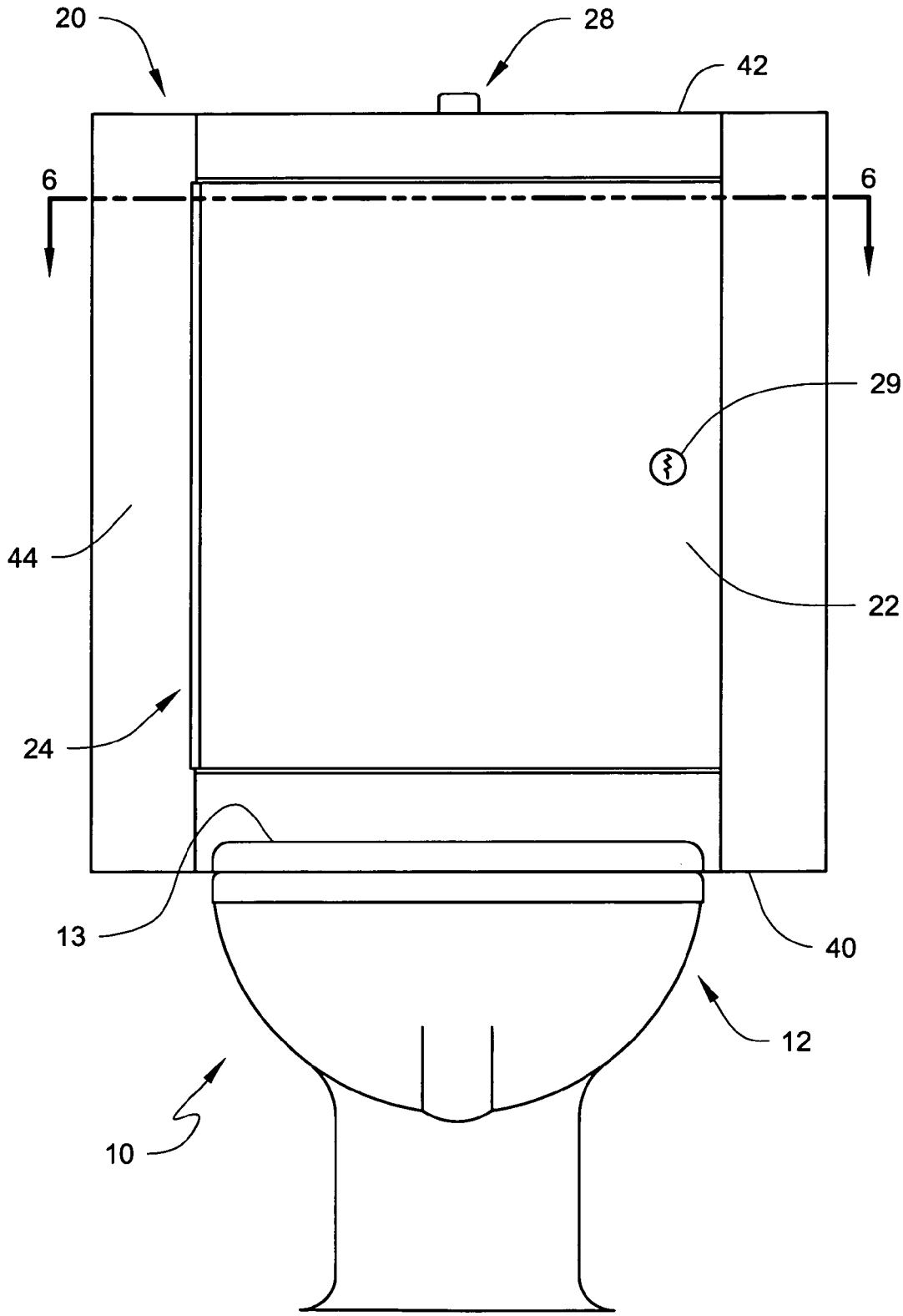
FIG. 3 is a front view of the toilet shown in FIG. 1 including a pressure-assisted flush assembly that includes an enclosure secured to a toilet bowl.

FIG. 3 shows a front view of the toilet 10 as shown in FIG. 1. The enclosure 20, as shown in FIG. 3, includes generally a bottom panel 40 configured to allow plumbing lines (e.g., plumbing lines 72, as shown in FIG. 4) to connect the pressure-assisted flush water tank 60 to the toilet bowl 12 and further configured to secure the bottom panel 40 adjacent surface 17 of the toilet bowl 12. Further, the enclosure 20, as shown in FIG. 3, includes a top panel 42 and one or more side panels 44 extending from the bottom panel 40 to the top panel 42.

The one or more side panels 44 are configured to enclose the pressure-assisted flush water tank 60, along with the top and bottom panels 40, 42. Further, the one or more side panels 44 are configured to allow plumbing lines to connect a water supply 504 to the pressure-assisted flush water tank 60 (e.g., plumbing lines 70, as shown in FIG. 4). Further, the one or more side panels 44 are configured to secure the one or more side panels 44 to the wall 14.

Enclosure 20 may be of any size or shape suitable for carrying out one or more of the functions provided thereby. For example, the enclosure 20 is sized so as to enclose the entire pressure-assisted flush water tank when mounted to wall 14. Further, the enclosure 20 is configured so as to prevent vandalism to one or more components of the toilet 10 (e.g., plumbing lines, flush water tank, etc.). Yet further, the enclosure 20 provides an aesthetically pleasing commercial toilet. However, the enclosure 20 may be used in a residential setting as well as a commercial setting.

Yet further, the enclosure 20 may be employed with assisted flush water tanks that are not compressed air-assisted. For example, assisted flush water tanks may include vacuum assisted tanks such as the Vacuity® vacuum assisted toilet available from Briggs Plumbing Products, Inc.; or may include a Duo-Flo, dual flush mechanism as available from Caroma USA, Inc. One or more various assisted flush water tanks may benefit from the use of the enclosure as described herein.

The enclosure 20 may be formed of any suitable material. For example, stainless steel, powder coat steel, plastic (e.g., rigid white plastic), or china may be used for one or more embodiments of the enclosure 20.

In one embodiment, the enclosure 20 is securely fastened to the wall 14 by one or more various techniques. For example, as shown in FIG. 4, the enclosure 20 includes various attachment tabs or brackets 38 by which the enclosure 20 may be attached to wall 14. The attachment using the brackets 38 may employ screws, bolts, etc. However, such attachment may be accomplished by any number of components, including bolts, glue, cements, epoxies, etc.

The one or more side panels 44 extending from the bottom panel 40 to the top panel 42 may completely enclose the pressure-assisted flush water tank 60. In one embodiment, the one or more side walls form only a front of the enclosure 20, and the back of the enclosure 20 is at least partially, and may be entirely, open to allow plumbing lines 70 to easily connect the water supply source 504 to the pressure-assisted flush water tank 60. For example, as shown in FIG. 4, the back side may be open with a brace 43, or a plurality of braces, attached to the ends of the side panel 44 for stabilization of the enclosure 20. In other words, the one or more side panels 44 and top and bottom panels 40, 42 may completely enclose the compressed air-assisted flush water tank 60 alone or may completely enclose the compressed air-assisted flush water tank 60 when used in conjunction with wall 14 (e.g., when secured thereto).

The panels may be formed integrally with one another, or may be formed separately and connected in some fashion (e.g., welding, connectors, screws, bolts, adhesives, etc.) In other words, the top panel 42, the bottom panel 40, and the side panels 44 may be formed of a single continuous material.

The enclosure 20 may also employ the use of one or more trim elements (e.g., trim sleeves). For example, as shown in FIG. 1, optional trim elements 47 (shown generally in dashed line) may be used to provide a full enclosure of the flush water tank 60 if one or more panels forming the enclosure cannot be positioned adjacent, in contact with, and/or securable to the wall 14. Such trim elements 47 are sized and configured to be securable to the rest of the enclosure (e.g., either on an outer surface thereof, or on an inner surface thereof) and also securable to wall 14. For simplicity purposes, unless otherwise stated, whenever the term panel or enclosure is used herein, such terms encompass the use or non-use of trim elements as a part thereof.

The enclosure 20 includes the access door 22 which allows access to the interior volume formed by enclosure 20. The access door 22 may be formed as part of a side panel 44, as shown in FIG. 1, or may be formed as part of the top panel, as shown and which will be further described with reference to FIG. 7.

In one embodiment, the access door 22 is pivotable about hinge 24. The hinge 24 may be a piano hinge, a door-type hinge, a hinge integral with the panel, etc. However, any other structure allowing the access door 22 to be opened and closed may be used (e.g., easily removable attachment components, such as screws, bolts, holding structure such as one or more engaging or interlocking edges on the perimeter of the access door which engage with other portions of the enclosure, the lock mechanism, etc.). For example, as shown generally in FIG. 7 and as described further herein, the access door may be removable (e.g., liftable) from other portions of the enclosure as opposed to being hinged or otherwise continually attached to the rest of enclosure when opened.

Further, the access door 22 is secured with a lock mechanism 29 to prevent unauthorized access to the pressure-assisted flush water tank 60 and/or other components located within the interior of enclosure 20. The locking mechanism 29 may take any suitable form, including key locks, master locks, pad locks, lockable latches, or lockable interlocking devices.

FIG. 4 shows a front view of the pressure-assisted flush assembly 16 shown in FIGS. 1 and 3 with the front of side panel 44 removed so as to uncover the contents enclosed thereby. FIG. 5 shows a side cross-section view taken along line 5-5 of FIG. 4, and FIG. 6 shows a top cross-section view taken along line 6-6 of FIG. 3. As shown in such FIGS. 4-6, the pressure-assisted flush assembly 16 includes the compressed air-assisted flush water tank 60 enclosed and installed within enclosure 20. The pressure-assisted flush assembly 16 also includes water supply plumbing lines 70 to connect the water supply 504 to a water supply inlet apparatus 62 of the compressed air-assisted flush water tank 60. Further, tank-to-bowl plumbing lines 72 provide for connection of a discharge apparatus 63 of the compressed air-assisted flush water tank 60 to an inlet or opening 23 of toilet bowl 12.

As used herein, plumbing lines refers to any components necessary for completing a connection between two components (e.g., between water supply and a flush water tank, between a flush water tank and a toilet bowl, etc.). For example, but clearly not limited thereto, plumbing lines may include pipes, tubes, fittings, gaskets, valves, shut-off valves, nuts, screws, gaskets, etc. Further, such components may be formed of one or more various materials such as metals, plastics, rubber, ceramics, etc.

The compressed air-assisted flush water tank 60 may include any suitable compressed air-assisted flush water tank available on the market. As used herein, a compressed air-assisted flush water tank means any flushing device that employs compressed air to carry out a flush cycle. For example, as indicated in the Background of the Invention section herein, exemplary compressed air-assisted flush water tanks that may be used or modified for use in the present invention are available from Sloan Valve Company (Franklin Park, Ill.), and referred to or sold under the trade designation FLUSHMATE® (e.g., 503, 504 series, or another series available therefrom); an Aqua Saver pressure assisted toilet available from Eljer; a Cadet Round Frount Pressure Assist Toilet available from American Standard; a K-1413 Pressure Lite Toilet Tank available from Kohler; or a PF/2 Energizer System available from Chicago Faucets). However, any other type of compressed air-assisted flush water tank will work as well.

Figure 9:
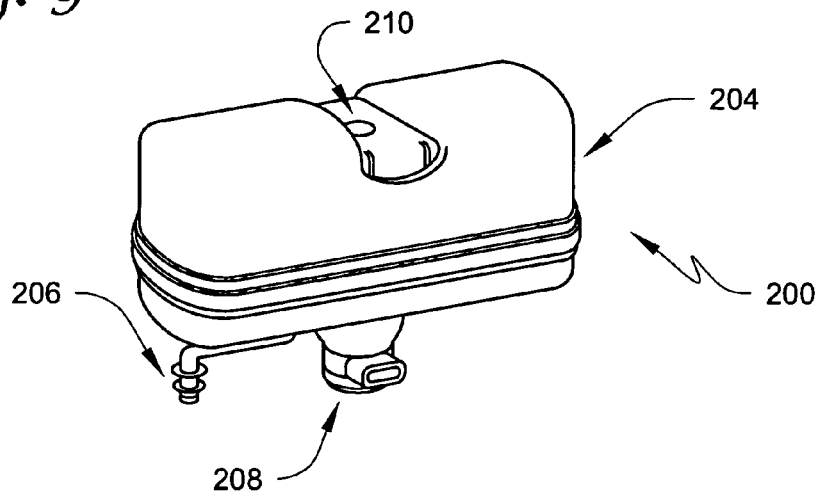
FIG. 9 is a perspective view of a compressed air-assisted flush water tank that may be used according to the present invention in a pressure assisted flush assembly of a toilet such as that shown in FIGS. 1 and 3-8.

A perspective view of an illustrative compressed air-assisted flush water tank 200 is shown in FIG. 9. The compressed air-assisted flush water tank 200 generally includes a tank 204, a water supply inlet apparatus 206 for connection to a water supply line, a discharge apparatus 208 for connection to a toilet bowl inlet (e.g., the discharge apparatus 63 generally has a check valve associated therewith for preventing leaks), as well as a plunger device 210 configured to operate the compressed air-assisted flush water tank 200. In other words, plunger device 210 initiates a flush cycle.

Figures 10A, 10B, 10C:
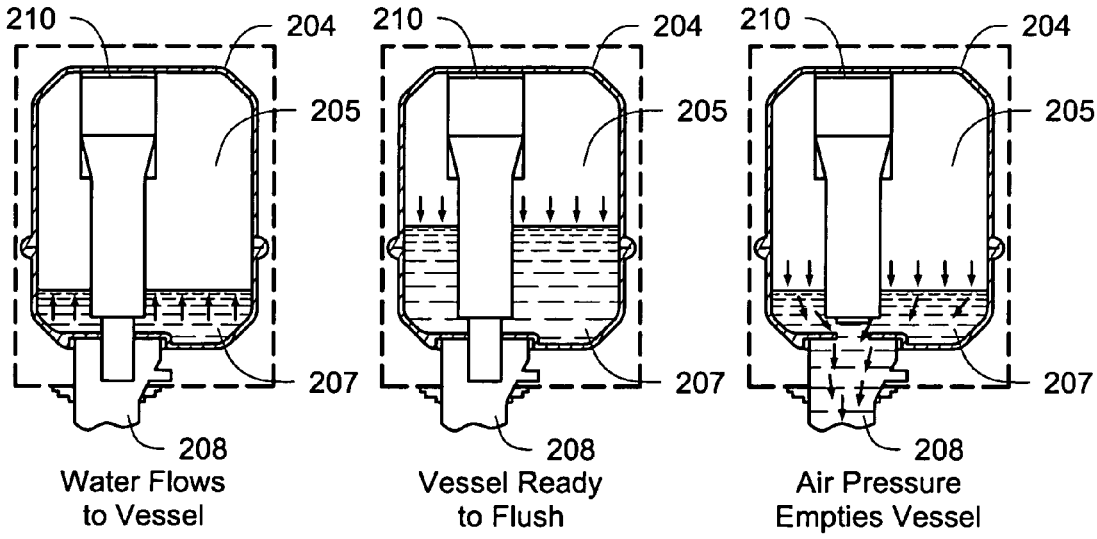
FIGS. 10A-10C are cross-section views of the compressed air-assisted flush water tank shown in FIG. 9 for illustration of its method of operation.

In operation, as shown by FIGS. 10A-10C, as water from the water supply line fills the tank 204, as shown in FIG. 10A, the air 205 becomes trapped and is compressed, as shown in FIG. 10B. Air pressure builds up until it is approximately equal to the water supply line pressure, at which time the water fill stops and the compressed air-assisted flush water tank 200 is ready to be used (i.e., flushed). When the plunger device 210 (i.e., actuator) of the compressed air-assisted flush water tank 200 is activated, a combination of air and water is released, creating a jet or turbo propulsion effect. The compressed air inside the tank increases the potential energy of the system. When a flush occurs, energy within the tank 204 pushes the water 207 into the toilet bowl via discharge apparatus 208. As previously indicated, any flush water tank that utilizes compressed air to carry out a flush cycle may be utilized according to the present invention.

As shown in FIG. 4, at least in one embodiment, such as in a retrofitting of a flush valve toilet, water supply source 504 is connected to the water supply inlet apparatus 62 of the compressed air-assisted flush water tank 60. The plumbing lines 70 reside substantially within wall 14.

A water supply line 72 from the discharge apparatus 63 of the compressed air-assisted flush water tank 60 is used for connecting the flush water tank 60 to an opening or inlet 23 of the toilet bowl 12. As shown in FIG. 4, the bottom panel 40 of the enclosure 20 defines an opening 33 sized according to plumbing supply line 72 and opening or inlet 23 of the toilet bowl 12. A sealing material or gasket 56 is used to seal the connection therebetween. For example, the sealing material 56 may include a rubber gasket or one or more components formed of any other suitable material.

Further, the bottom panel 40 also defines openings 39 through which connection elements 58 may be used to secure the enclosure 20 to surface 17 of toilet bowl 12. For example, as shown in FIGS. 4-5, lag bolts and nuts 58, or any other securing devices and/or components (e.g., nuts, washers, etc.), may be used for making a physically secure connection between the enclosure 20 and toilet bowl 12.

Also, as shown in FIG. 4, in one embodiment, an optional water holding container 80 (e.g., drip container) may be enclosed by enclosure 20 and positioned at least partially beneath the compressed air-assisted flush water tank 60. The water holding container 80 provides an interior 81 thereof. The water holding container 80 includes a tapered end 82 which terminates in a defined opening 85. The defined opening 85 is sized and configured for allowing connection of water supply line 72 to inlet or opening 23 of toilet bowl 12. The water holding container 80 further includes side walls 84 extending from the tapered end 82. The side walls 84 extend, at least in one embodiment, about and around at least a portion of the compressed air-assisted flush water tank 60 (e.g., about the perimeter of the tank 60).

The water holding container 80 may be formed of any suitable material. For example, the water holding container 80 may take the form of a plastic tub or any other container suitable for retaining a fluid.

An optional float switch 90 may be positioned in the interior 81 of the water holding container 80. The float switch 90 is coupled to a shutoff valve 91 of the water supply. During normal operation, the float switch is inactive. However, when water contained in the water holding container 80 reaches the float switch 90 (e.g., during a malfunction and leak) and changes its initial position, the float switch 90 actuates shutoff valve 91 to shut off water from the water supply source 504 in plumbing line 70. In other words, an automatic water supply shutoff valve 91 is configured to be actuated by the float switch 90. In such a manner, malfunction or leaking is contained within the enclosure 20, ceasing operation of the toilet 10 until maintenance can be provided.

In one embodiment, the water holding container 80 may be a drip tray (e.g., a plastic tray with an opening for allowing connection of the tank to the bowl) positioned at the bottom of the enclosure 20 adjacent the bottom panel 40 to collect a small amount of water. In this embodiment, no float switch is used to prevent prolonged leakage (e.g., a check valve of the assisted flush water tank prevents substantial flooding). The drip tray may be size slightly larger than the flush water tank 60 so as to catch any small amount of water dripping therefrom.

Also, as shown in FIGS. 4-6, an accessible activator mechanism 28 (e.g., an activator mechanism operable outside of the locked enclosure 20) is coupled to the plunger device 65 configured to operate the compressed air-assisted flush water tank 60. The activator mechanism 28 forms a part of an actuator assembly 27 which includes a pushbutton extension 49 for coupling the activator mechanism 28 to plunger 65 of the compressed air-assisted flush water tank 60 to commence a flushing cycle upon activation. One will recognize that the actuator assembly may include one or more various components configured to activate the plunger device 65 of the compressed air-assisted flush water tank 60. For example, without limitation, such activator components may include pushbuttons, motion sensors, levers, arms, electronic sensors, automatic flush devices, battery operated electric flush devices, Intelli-Flush or electric sensors, etc.

Further, for example, such activation of the flush may be carried out automatically without human physical touch of an activator or actuation component. For example, if an automatic flush is desired, a motion sensor could be mounted on the enclosure 20 with all parts and wires secured behind or within the interior thereof. Further, the flush could be on a timer.

Figure 7:
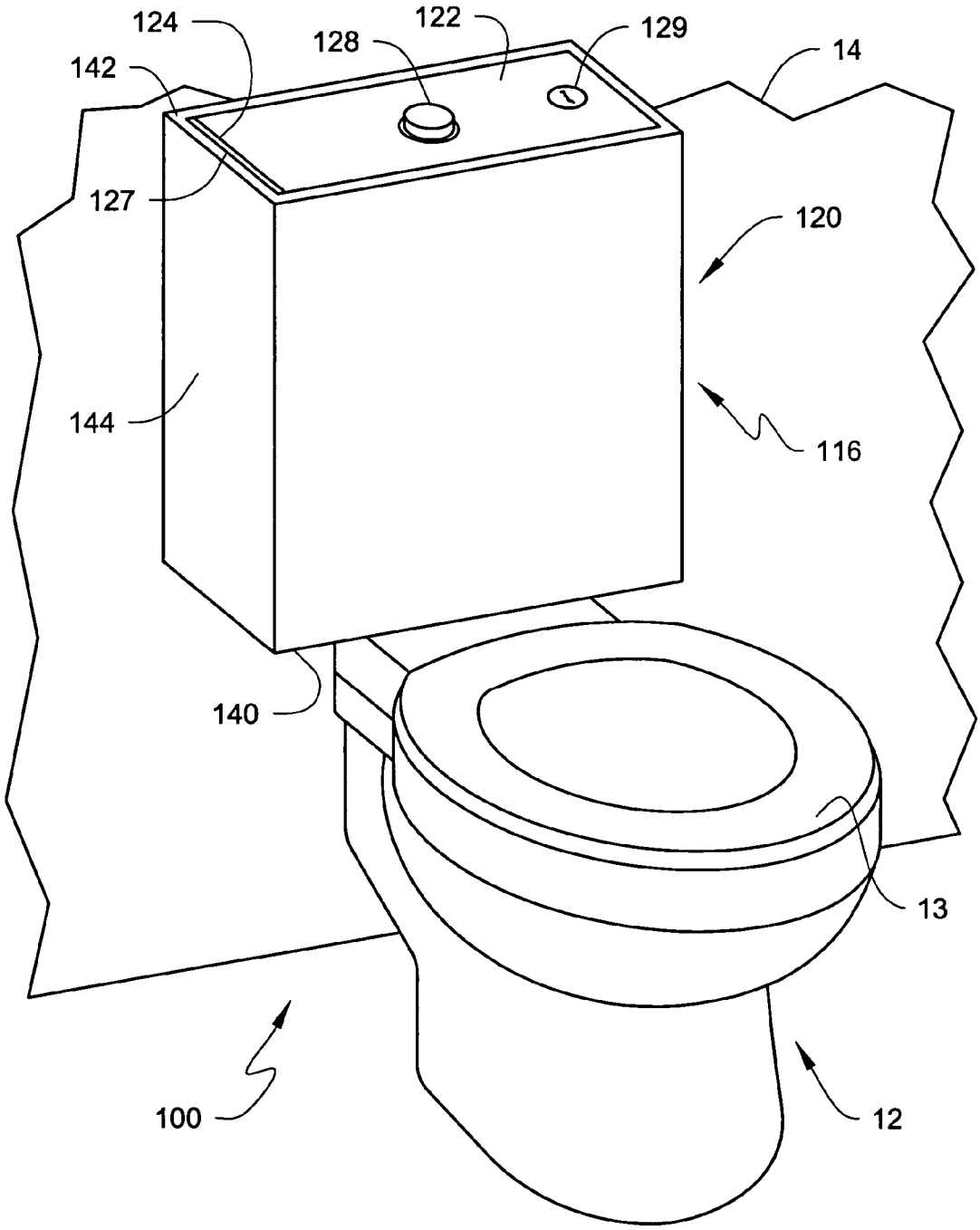
FIG. 7 is a perspective view of an alternate toilet configuration according to the present invention.
Figure 8A:
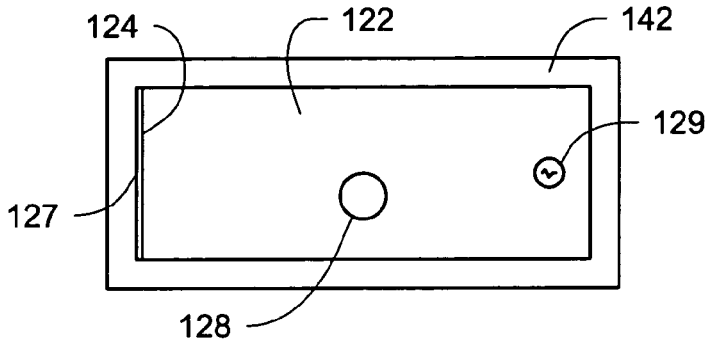
FIGS. 8A-8D show a top view, a front view, a bottom view, and a side view, respectively, of the enclosure of the toilet shown in FIG. 7 according to the present invention.
Figure 8B:
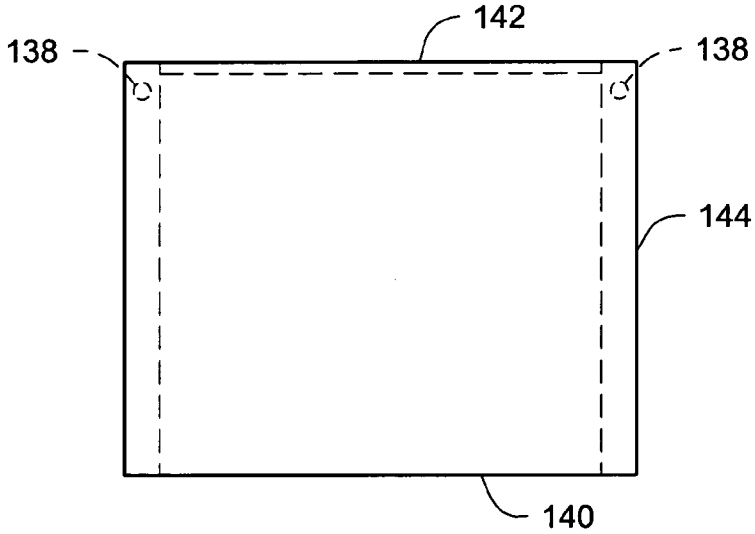
Figure 8D:
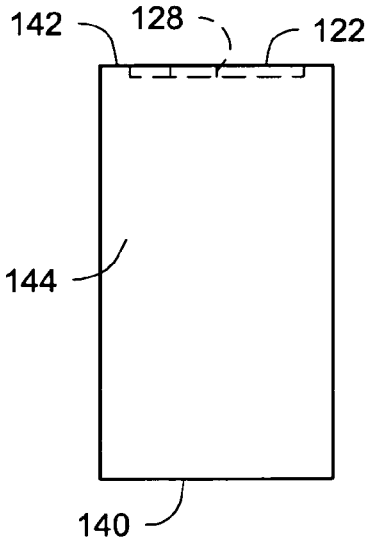
Figure 8C:
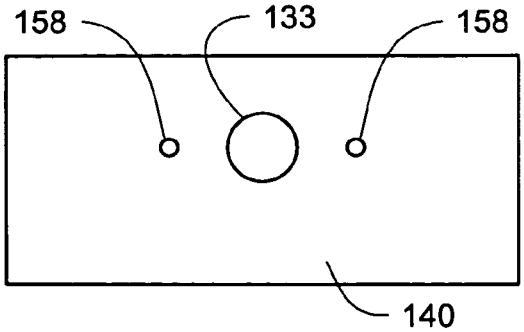

FIG. 7 is a perspective view of an alternate toilet 100 according to the present invention which includes a pressure-assisted flush assembly 116. The pressure-assisted flush assembly 116 includes an enclosure 120 which, at least in one embodiment, is secured to wall 14. The enclosure 120 includes an access door 122 configured to allow access to an enclosed flush water tank (not shown). Generally, the enclosure 120 includes a bottom panel 140, a top panel 142, and one or more side panels 144. The access door 122 is removable from other portions of the top panel 142 (e.g., a lift out access door completely removed from the enclosure). In one embodiment, the access door 122 is configured such that one or more perimeter edges 124 thereof engage with one or more edges 127 defining an opening to receive the access door 122 (e.g., at a position opposite the lock mechanism). The access door 122 is secured in position with a lock mechanism 129 to prevent unauthorized access to the enclosed flush water tank. The lock mechanism 129 assists in holding the access door 122 in position in conjunction with the engagement of the one or more edges. For example, at a first end of the access door 122 an interlocking latch may be used and at a second (e.g., opposite) end a key lock may be employed to retain the removable access door 122 in position.

FIGS. 8A-8D show the enclosure 120 in a more detailed top view, front view, bottom view, and side view, respectively. As shown therein, the enclosure 120, includes the bottom panel 140 configured (e.g., with opening 133) to allow plumbing lines (e.g., plumbing lines 72, as shown in FIG. 4) to connect the pressure-assisted flush water tank (not shown) to the toilet bowl 12 and further configured (e.g., with openings 158) to secure the bottom panel 40 adjacent surface 17 of the toilet bowl 12. Further, the enclosure 120 includes the top panel 142 configured with the access door 122 and with an accessible activator mechanism 128 (e.g., mounted to a portion of the top panel enclosing the flush water tank) to activate a plunger device associated with the compressed air-assisted flush water tank (not shown) enclosed in the enclosure 120.

The one or more side panels 144 extend from the bottom panel 140 to the top panel 142 to enclose the pressure-assisted flush water tank (not shown). Further, for example, the one or more side panels 144 are configured (e.g., an open back side mounted to the wall 14) to allow plumbing lines to connect a water supply 504 to the enclosed pressure-assisted flush water tank (e.g., plumbing lines 70, as shown in FIG. 4). Further, the one or more side panels 144 may be configured (e.g., with openings 138) for use in securing the one or more side panels 144 to the wall 14.

One will recognize that the present invention may overcome one or more of the problems of previously installed toilets and, in particular, flush valve toilets. For example, the present invention employing a compressed air-assisted flush water tank may use, for example, only one gallon or less per flush (e.g., about 0.8 gallons). Further, the flush mechanism is not sensitive to particles in the water and rarely fails or needs repair. In the event of an unlikely failure, detection of the problem occurs quickly, as the unit stops working and does not allow for continual water waste as a result of the toilet continually running.

Yet further, at least in one embodiment, the flush mechanism is a simple exterior pushbutton that activates a simple plunger to release the combination of air pressure and water. The air pressure is created in the air tight flush water tank as it fills with water. The tank, as it fills with water, has the same pressure as the domestic water supply infrastructure. Most city water supply lines have about 65 PSI which will equal the same PSI in the flush water tank when full. When the plunger in the flush water tank is activated, a combination of air and water is released, creating a jet or turbo propulsion effect.

Yet further, at least in one embodiment, a plastic tub tank contains the compressed air-assisted flush water tank and all the plumbing connections that are susceptible to failure, such as pipe connections and pipes. In the event of a failure, a switch (e.g., a float switch, a water detection sensor, etc.)

activates a shutoff valve in the water supply line to the fixture. In the event of a leak, the volume of water allowed to escape is very small and contained inside the water holding container, eliminating the possibility of any flooding.

Yet further, the pressure-assisted flush assembly 16, at least in one embodiment, provides a pressure flush in the toilet bowl 12. The pressure flush allows for a larger throat in the bottom of the toilet bowl 12 and requires only one turn in the toilet bowl before the waste reaches the sanitary sewer line.

Further, at least in one embodiment, the present invention deters vandalism because all the working parts are secured in a wall-mounted enclosure 20 with a lock mechanism 29. This prevents the opportunity for would-be vandals to tamper with any part of the toilet that would cause a malfunction.

Yet further, and as will be described further herein, the present invention may be used to retrofit flush valve toilets which have exposed chrome piping. This results in a satisfactory appearance without undertaking extensive demolition of walls or replacing wall coverings, such as tile, etc. The enclosure 20 is designed so that it covers the old plumbing wall openings when old exposed chrome piping is removed during a retrofit, and also hides the new plumbing required for a retrofit connection. Such a retrofit of flush valve toilets with tank-type toilets is typically undesirable in a commercial venue because of the non-commercial appearance and problems with removal of the lid of the tank and potential for tampering with internal parts.

The present invention satisfies a need and solves problems associated with retrofitting toilets. Yet further, in addition to providing a highly desirable alternative to flush valve toilets, the present invention may be used with either floor-mount or wall-mount toilets, as well, without alteration or changing wall hangers, floor connections, or any other waste lines, as further described herein. In other words, the present invention may be used for installing a toilet or retrofitting a previously installed toilet.

For example, in installing a toilet, a compressed air-assisted flush water tank 60 is provided. An incoming water line 504 is connected to the flush water tank 60, and the flush water tank 60 is connected to toilet bowl 12. The flush water tank 60 is enclosed using the enclosure 20. An accessible activator mechanism 28 for use in activation of the plunger device of the flush water tank 60 is installed, as well.

With respect to a retrofit operation for a flush valve toilet 500 such as shown in FIG. 2, a flush valve 502 of the flush valve toilet 500 is removed. As shown in FIG. 2, the flush valve 502 includes a handle 503 for activating a flush cycle. Upon removal of the flush valve 502, plumbing lines 70 are utilized to connect the water source 504 to the compressed air-assisted flush water tank 60. For example, the flush valve assembly and stop of the flush valve is removed back to the wall and a shut-off valve (e.g., an Accor Push-On shut valve that includes a supply tube) is installed such that plumbing lines 70 can be used to couple the water source 504 to the flush water tank 60. The flush water tank 60 is connected by plumbing lines 72 to toilet bowl 12. Further, enclosure 20 is utilized to close and securely lock components of the system in place. One will recognize that the enclosure 20 may be installed before, after, or in conjunction and during the same time as installation of the compressed air-assisted flush water tank 60.

Figure 11:
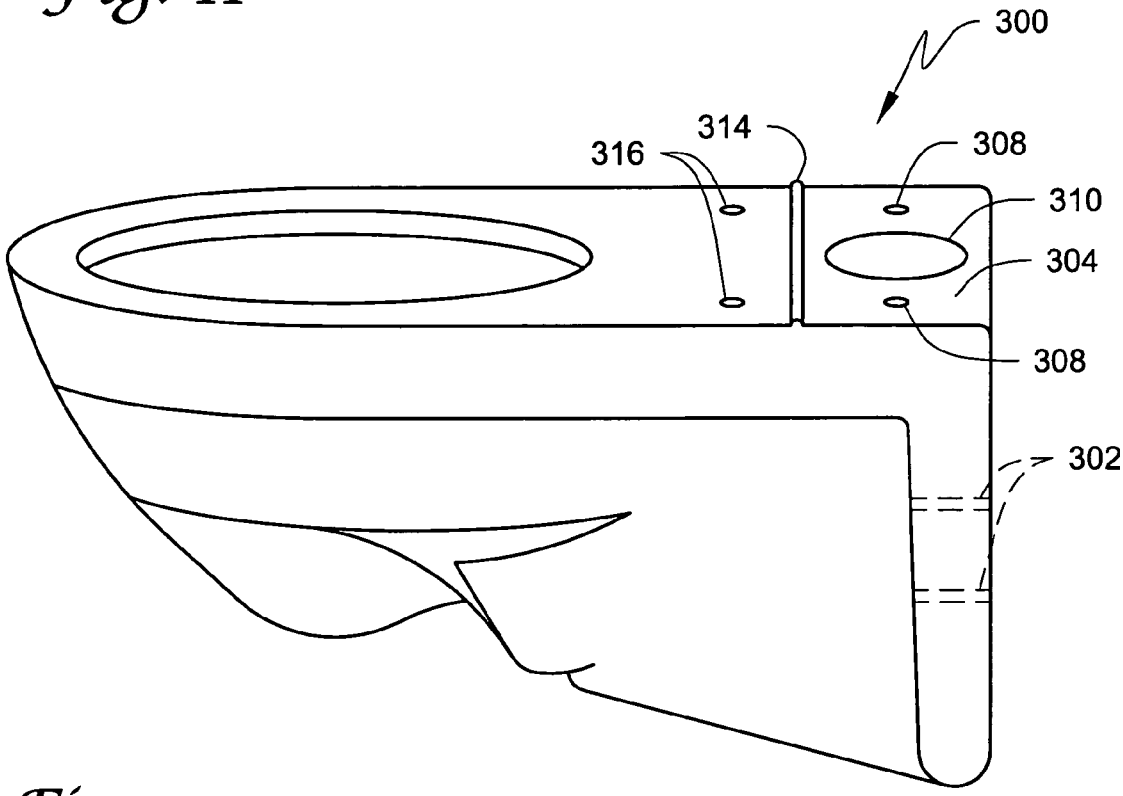
FIG. 11 is a perspective view of a wall mount toilet bowl that may be used in the toilet as shown in FIGS. 1 and 3-8 according to the present invention.
Figure 12:
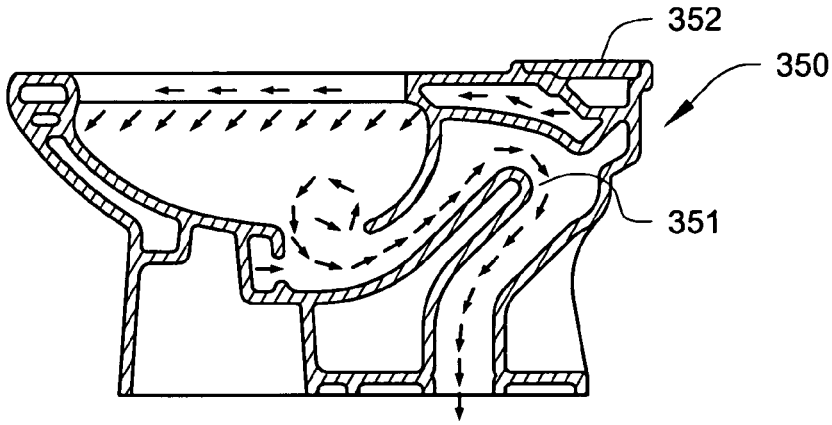
FIG. 12 is a cross-section side view of a floor mount toilet bowl that may be used in a toilet such as shown in FIGS. 1 and 3-8 according to the present invention.

One will recognize that the pressure-assisted flush assembly 16, as shown in FIG. 1, may be used in conjunction with both pressure assisted wall-mounted toilet bowls, such as toilet bowl 300 shown in FIG. 11, as well as pressure assisted floor-mounted toilet bowls, such as toilet bowl 350 shown in FIG. 12. For example, as shown in FIG. 11, wall-mounted toilet bowl 300 includes surface 304 upon which enclosure 20 may be secured using components, such as bolts, in combination with openings 308 in a wall-mounted toilet bowl 350. Further, inlet 310 is fluidly coupled to the compressed air flush water tank. Ridge 314 assists in locating the enclosure 20 on surface 304. Openings 316 provide a way to mount a seat (not shown), and openings 302 provide a way for mounting the wall toilet bowl 350 with bolts and/or the bowl may be mounted using a wall hanger, as well as any other suitable components.

Further, as shown in FIG. 12, the floor mount toilet bowl 350 includes surface 352 upon which enclosure 20 may be secured. The toilet bowl 350 is hydraulically designed to "push" contents out of the trapway 351 instead of a gravity siphoning. Siphoning requires a more complicated trapway, impeding performance. The trapway 351 is simple, only needing one bend.

Various toilet bowls may be used with the present invention. For example, any pressure assisted toilet bowl may be used, such as 1.6 gallon GPF available from American Standard, Eljer, Mansfield Plumbing, etc. or 1.0 gallon GPF pressure assisted toilet bowls available from American Standard, Eljer, Mansfield Plumbing etc.

In other words, at least in one embodiment of the present invention, in addition to providing a highly desirable alternative to using flush valves with toilets, the present invention will work with either floor mount or wall mount toilets without alteration to or changing one or more of the wall hangers, floor connections, or any of the waste lines. Further, for example, without limitation, the present invention may also be used with free-standing, or other toilets that may be presently known, or developed in the future.

All patents and references cited herein are incorporated in their entirety as if each were incorporated separately. This invention has been described with reference to illustrative embodiments and is not meant to be construed in a limiting sense. Various modifications of the illustrative embodiments, as well as additional embodiments of the invention and combinations of various elements herein, will be apparent to persons skilled in the art upon reference to this description. It is therefore contemplated that the patented claims will cover any such modifications or embodiments that may fall within the scope of the present invention as defined by the accompanying claims.

What is claimed is:

1. A pressure assisted flush assembly for use with a toilet, the assembly comprising:

a compressed air assisted flush water tank, wherein the flush water tank comprises a plunger device configured to operate the flush water tank;

one or more plumbing lines for use in connecting an incoming water line to the flush water tank and the flush water tank to a toilet bowl;

at least one panel for use in enclosing the flush water tank, wherein the at least one panel comprises an access door configured to allow access to the flush water tank, and further wherein the access door is secured with a lock mechanism to prevent unauthorized access to the flush water tank;

a water holding container enclosed by the at least one panel and positioned at least partially beneath the flush water tank, wherein the water holding container defines an interior thereof configured to receive water; and an accessible activator mechanism is configured to activate the plunger device of the flush water tank.

2. The assembly of claim 1, wherein the assembly is configured to retrofit a previously installed toilet.

3. The assembly of claim 2, wherein the previously installed toilet is a flush valve toilet.

4. The assembly of claim 3, wherein the at least one panel is configured for attachment to a wall to enclose the flush water tank and cover any plumbing lines in the wall connected to the flush water tank.

5. The assembly of claim 1, wherein a float switch is positioned in the interior of the water holding container, and further wherein an automatic water supply shut off valve is configured to be actuated by the float switch.

6. The assembly of claim 1, wherein the at least one panel comprises a bottom panel configured to allow plumbing lines to connect the flush water tank to the toilet bowl and secure the bottom panel to the toilet bowl, one or more side panels configured to allow plumbing lines to connect a water supply to the flush water tank and to secure the one or more side panels to a wall, and a top panel, wherein the top panel comprises an accessible activator mechanism centered with respect to the width of the top panel, and further wherein the accessible activator mechanism is coupled to the plunger device that is also centered with respect to the width of the top panel to operate the flush water tank.

7. The assembly of claim 6, wherein the top panel comprises the access door as a part thereof wherein the access door is removable from other portions of the top panel, and further wherein the access door of the top panel comprises the accessible activator mechanism coupled to the plunger device configured to operate the flush water tank.

8. A method for use in installing a toilet, the method comprising:

providing a compressed air assisted flush water tank, wherein the flush water tank comprises a plunger device configured to operate the flush water tank;

connecting an incoming water line to the flush water tank;

connecting the flush water tank to a toilet bowl;

enclosing the flush water tank using at least one panel, wherein the at least one panel comprises an access door configured to allow access to the flush water tank, and further wherein the access door is secured with a lock mechanism to prevent unauthorized access to the flush water tank;

positioning a water holding container enclosed by the at least one panel at least partially beneath the flush water tank, wherein the water holding container defines an interior thereof configured to receive water; and installing an accessible activator mechanism for use in activation of the plunger device of the flush water tank.

9. The method of claim 8, wherein the method further comprises removing a flush valve on a previously installed toilet.

10. The method of claim 8, wherein the method further comprises removing at least a toilet tank of a previously installed toilet.

11. The method of claim 8, wherein enclosing the flush water tank using at least one panel comprises attaching the at least one panel to a wall to enclose the flush water tank and cover any plumbing lines in the wall connected to the flush water tank.

12. The method of claim 8, wherein the method further comprises:

positioning a float switch in the interior of the water holding container at an initial location; and automatically shutting off a water supply to the flush water tank based on a changed location of the float switch.

13. The method of claim 8, wherein the at least one panel comprises a bottom panel configured to allow plumbing lines to connect the flush water tank to the toilet and secure the bottom panel to the toilet, one or more side panels configured to allow plumbing lines to connect a water supply to the flush water tank and to secure the one or more side panels to a wall, and a top panel.

14. The method of claim 9, wherein the top panel comprises the access door as a part thereof, wherein the access door is removable from other portions of the top panel, and further wherein the access door of the top panel comprises an accessible activator mechanism coupled to the plunger device configured to operate the flush water tank.

15. An enclosure for use in installing a toilet with an assisted flush water tank, wherein the flush water tank comprises a plunger device configured to operate the flush water tank, wherein the enclosure comprises:

a bottom panel configured to allow plumbing lines to connect the flush water tank to a toilet bowl and configured to secure the bottom panel to the toilet;

a top panel;

one or more side panels extending from the bottom panel to the top panel configured to enclose the flush water tank, wherein the one or more side panels or the bottom panel are configured to allow plumbing lines to connect a water supply to the flush water tank and configured to secure the one or more side panels to a wall, and further wherein at least one of the top panel and the one or more side panels comprises an access door configured to allow access to the flush water tank, wherein the access door is movable with respect to other portions of the at least one of the top panel and the one or more side panels, and further wherein the access door is secured with a lock mechanism to prevent unauthorized access to the flush water tank; and a water holding container positioned adjacent the bottom panel and at least partially beneath the flush water tank when installed, wherein the water holding container defines an interior thereof configured to receive water.

16. The enclosure of claim 15, wherein the top panel comprises an access door as a part thereof, wherein the access door is removable from other portions of the top panel, and further wherein the access door of the top panel comprises an accessible activator mechanism coupled to the plunger device configured to operate the flush water tank.

17. The enclosure of claim 15, wherein at least one of the top panel and the one or more side panels comprises an accessible activator mechanism coupled to the plunger device for use in operation of the flush water tank.

18. The enclosure of claim 15, wherein the top panel, bottom panel and the one or more side panels are configured to cover a removed flush valve connection of a previously installed toilet and any plumbing lines in the wall connected to the flush water tank.

19. The enclosure of claim 15, wherein a float switch is positioned in the interior of the water holding container, and further wherein an automatic water supply shut off valve is configured to be actuated by the float switch.

20. The enclosure of claim 15, wherein the enclosure is configured to retrofit a flush valve toilet.

* * * * *